US005439038A

United States Patent [19]

Lewis et al.

[11] Patent Number: 5,439,038

[45] Date of Patent: Aug. 8, 1995

[54] CARBONATED BEVERAGE CONTAINERS PRESSURIZING DEVICE

[75] Inventors: Garrett W. Lewis; Jeffrey M. Jablon, both of San Diego; James L. Labelle, Murrieta, all of Calif.

[73] Assignee: Consumer Product Technologies, Inc., San Diego, Calif.

[21] Appl. No.: 88,068

[22] Filed: Jul. 2, 1993

[51] Int. Cl.[6] ..... B65B 31/00

[52] U.S. Cl. ..... 141/64; 141/18; 141/26; 141/95; 141/329; 141/371; 141/372; 222/39; 221/96; 221/97; 215/235; 215/260; 417/63; 417/533

[58] Field of Search ..... 141/14, 15, 18, 21, 141/22, 25–28, 64, 67, 69, 70, 95, 323, 325, 326, 346, 329, 197, 348–350, 370–372; 222/39, 396, 397, 399, 401; 221/96, 97; 417/63, 470, 471, 533, 544, 545, 552, 559; 99/323.1; 215/228, 235, 260; 220/209, 36, 363; 261/30, 119.1, DIG. 7

[56] References Cited

U.S. PATENT DOCUMENTS

| | | | |
|---|---|---|---|
| 1,530,703 | 3/1925 | Snodgrass | 417/544 |
| 1,751,114 | 3/1930 | Walstrom | 141/349 X |
| 2,017,145 | 10/1935 | Dunn | 222/401 |
| 2,100,990 | 11/1937 | Valentine | 222/401 |
| 2,170,531 | 8/1939 | Kahn | 222/39 X |
| 2,862,528 | 12/1958 | Geisler | 141/70 X |
| 3,557,986 | 1/1971 | Poole, Jr. | 25/37 |
| 4,033,091 | 7/1977 | Saponara | 215/228 X |
| 4,524,877 | 6/1985 | Saxby et al. | 215/228 |
| 4,564,054 | 1/1986 | Gustavsson | 141/329 |
| 4,723,670 | 2/1988 | Robinson et al. | 25/228 |
| 4,763,802 | 8/1988 | Johnston | 215/228 |
| 4,763,803 | 8/1988 | Schneider | 215/260 |
| 4,823,968 | 4/1989 | Handzlik | 215/228 |
| 4,838,324 | 6/1989 | Boyd | 141/64 |
| 4,877,065 | 10/1989 | Lamboy et al. | 141/18 |
| 4,899,896 | 2/1990 | Metzger | 215/228 |
| 4,934,543 | 6/1990 | Schmidt | 215/228 |
| 4,981,233 | 1/1991 | Scheurer | 220/212 |
| 5,010,928 | 4/1991 | Ballas | 141/64 |
| 5,031,785 | 7/1991 | Lemme | 215/228 |

*Primary Examiner*—J. Casimer Jacyna

*Attorney, Agent, or Firm*—Henri J. A. Charmasson; John D. Buchaca

[57] ABSTRACT

An apparatus for repressurizing a partially emptied carbonated beverage bottle, comprises a stationary pumping station mountable against a wall or under a kitchen cabinet, and a set of bottle caps adapted for use on the pumping station. The station includes a pump operated by pushing a movable front panel section, a filling slot equipped with a air-supplying cannula, and a slot for holding the set of caps. Each cap has a resiliently self-sealing opening designed to be penetrated by the cannula when the bottle is inserted into the filling slot, and a pouring orifice closed by a thumb-activated and spring-biased stopper.

20 Claims, 4 Drawing Sheets

CARBONATED BEVERAGE CONTAINERS PRESSURIZING DEVICE

FIELD OF THE INVENTION

This invention relates to air pumps and more specifically to devices for repressurizing the inside of a carbonated beverage container after partial withdrawal of its contents.

BACKGROUND OF THE INVENTION

It is well-known that carbonated beverages such as sodas and seltzer waters which come in large size containers, lose their carbonation if they are not consumed after the container has been opened and a part of its contents has been poured out. The carbon dioxide which is diluted in the liquid remaining in the container escapes into the void left by the upper section of the bottle after a few servings have been poured out. When the bottle is opened again for the next serving, the mixture of air and carbon dioxide escapes. After the bottle is resealed, more diluted carbon dioxide escapes from the liquid into the air space until proper balance is reestablished between the two areas of the bottle. If only small servings are poured out over a period of time, the remaining beverage soon loses all its carbonation. An obvious solution to the problem is to repressurize the emptied area of the bottle after each serving has been poured to prevent further escape of the diluted carbon dioxide from the remaining liquid phase. The prior art offers many devices, basically small hand pumps with special fittings designed to replace the original cap or stopper of the beverage container, as exemplified by the device disclosed in U.S. Pat. No. 5,010,928 Ballas.

These portable repressurizing pumps are very awkward to use since they require holding the container as well as the pump while actioning the pump lever. Moreover, they are easily misplaced, or hard to find in a cluttered kitchen cabinet or drawer, and consequently are rarely used.

There is a need for a carbonated beverage repressurizing device which can be operated single-handedly, cannot be misplaced, and is readily and conveniently accessible every time the container is used.

SUMMARY OF THE INVENTION

The principal and secondary objects of this invention are to provide a simple apparatus to automatically repressurize the inside of a carbonated beverage container after part of its contents have been poured out, by simply inserting the neck of the container into a pressurizing station conveniently mounted on a kitchen wall, under a kitchen counter or even against the door or the wall of the refrigerator where the container is kept, and that can be activated single-handedly by persons of all ages and skills, even elderly or handicapped individuals who lack the dexterity to manipulate at the same time, a container, a hand-pump and its operating lever.

These and other objects are achieved by means of the combination of a self-sealing bottle cap designed to replace the original container stopper, and a stationary repressurizing station for pumping a fluid, preferably air or nitrogen into the voided part of the container. The station is securable to a vertical or horizontal surface, and comprises safety features as well as an esthetically attractive and compact housing.

DESCRIPTION OF THE PREFERRED EMBODIMENT OF THE INVENTION

Figure 1:
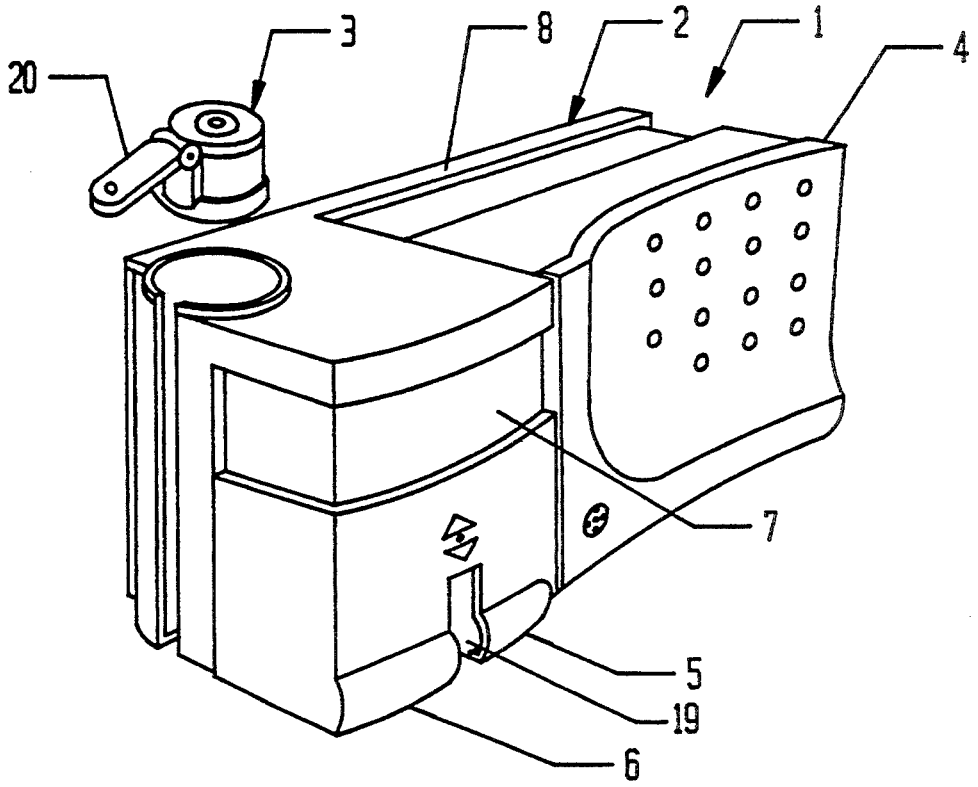
FIG. 1 is a perspective view of a carbonated beverage repressurizing apparatus according to the invention.

Referring now to the drawing, there is shown in FIG. 1 a carbonated beverage container pressurizing device 1 which comprises a pumping station 2 and at least one cap 3 to replace the original cap of a carbonated beverage container before its contents can be repressurized by means of the pump station 2.

Figure 2:
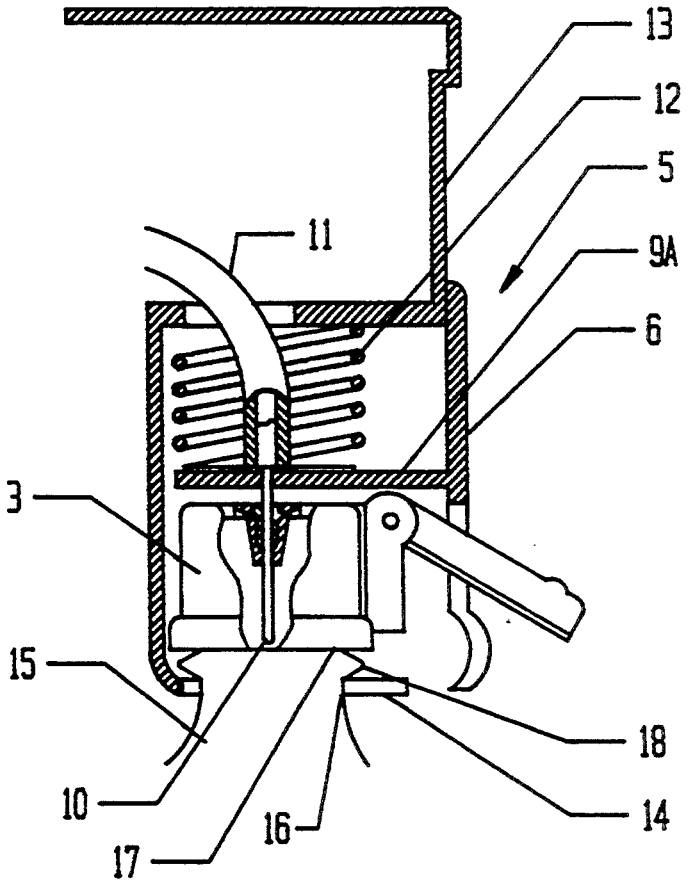
FIG. 2 is a cross-sectional view of the filling station.

The pump station 2 comprises an internal air pump activated by the reciprocal movement of a front panel 4. Pressurized air generated by the pump is fed to a filling station 5 installed in a recessed area behind a movable shield 6, as more particularly illustrated in FIG. 2. The shield slides up and down over a frontal and lateral section 7 of the pumping station housing 8. The shield 6 supports an internal, horizontal shelf *9a* upon which is mounted a vertically oriented cannula 10 that is connected to the pump by means of a flexible conduit 11. A coil-spring 12 vertically placed between the upper surface of the shelf and a portion 13 of the housing projecting over the filling station biases the shield 6 downwardly. A U-shaped flange 14 projects horizontally and fixedly across a lower area of the filling station immediately under the cannula 10. Once the shield 6 and the cannula 10 have been manually lifted the spout of a carbonated beverage bottle 15 which has been partially emptied and fitted with the cap 3 can be inserted into the filling station. The bottle is lined up with the cannula by positioning its neck 16 within the U-shaped flange so that either the lower edge 17 of the cap or the bottle spout ring 18 rests against the U-shaped flange 14. The bottle being thus supported in the filling station, the shield can be released to let the cannula 10 propelled by the coil-spring 12 penetrate the cap. A small slot 19 at the base of the shield 6 accommodates the opening lever 20 associated with the cap 3 as will be later explained.

Figure 4:
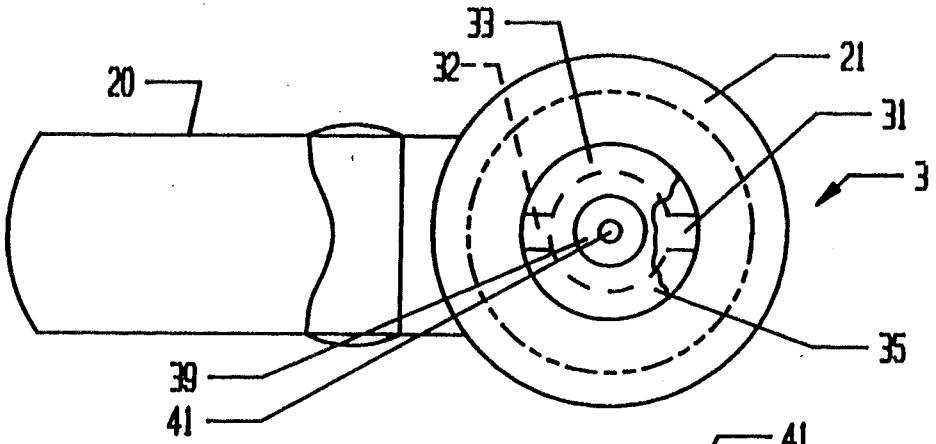
FIG. 4 is a top plan view thereof.

The operation of the cap 3 will now be explained with reference to FIGS. 4 and 5. The cap comprises a top 21 and a cylindrical, peripheral wall 22 having threads 23 along its inner surface mating with the threads on the spout of the bottle 15. The top 3 is separate from the peripheral wall 22 and is rotatively mounted by a pin 24 near an upper section 25 of the peripheral wall. The lever 20 integral with the top 21 projects in a downwardly oblique position for convenient manipulation by a person holding the neck of the bottle 16. The top 21 is biased toward a closed position by a spring 26 concentrically mounted on the pin 24 and bearing against the undersurface of the lever and a lateral outer area of the peripheral wall 22. At the base of the peripheral wall a L-shaped flange 27 projects outwardly and downwardly to accommodate any remaining portion 28 of the original bottle cap, such as the so-called "pilfer ring" which is crimped around the bottle neck and separates from the original screw-on cap during the initial opening of the bottle. A resilient sealing ring 29 is mounted against the undersurface of the cap 21 and surrounds a circular aperture 30, the rim of which defines two diametrically opposed notches 31 and 32. A sleeve 33 made of rubber or other resilient material is tightly mounted through the aperture 30 and extends from the upper surface 34 of the cap toward an internal area of it. The sleeve 33 has an outwardly projecting peripheral flange 35 which is nested in a circular depressed area of the top surrounding the aperture 30, and has substantially the same radial width as the notches 31 and 32. Accordingly, two small undersurfaces 36 and 37 of the sleeve flange are exposed to the inside of the container by the notches 31 and 32. Any excessive pressure within the container bearing against those exposed areas will cause the flange to distort and allow some of the pressurized gas inside the bottle to escape; thus acting as a safety valve.

The sleeve 33 has a central passageway 38 closed by a stopper 39 made of rubber or other resilient material. The stopper has a central channel 40 which tapers down from a bore 41 defining an intake hole near the upper surface 34 of the cap to a self-sealing pin-hole 42 at the lower tip of the stopper 39. The bore 41 is sized to receive the tip of the cannula 10, and the stopper material around the pin-hole 42 is resilient enough to expand when penetrated by the cannula tip, but to automatically close the pin hole when the cannula is withdrawn.

Figure 5:
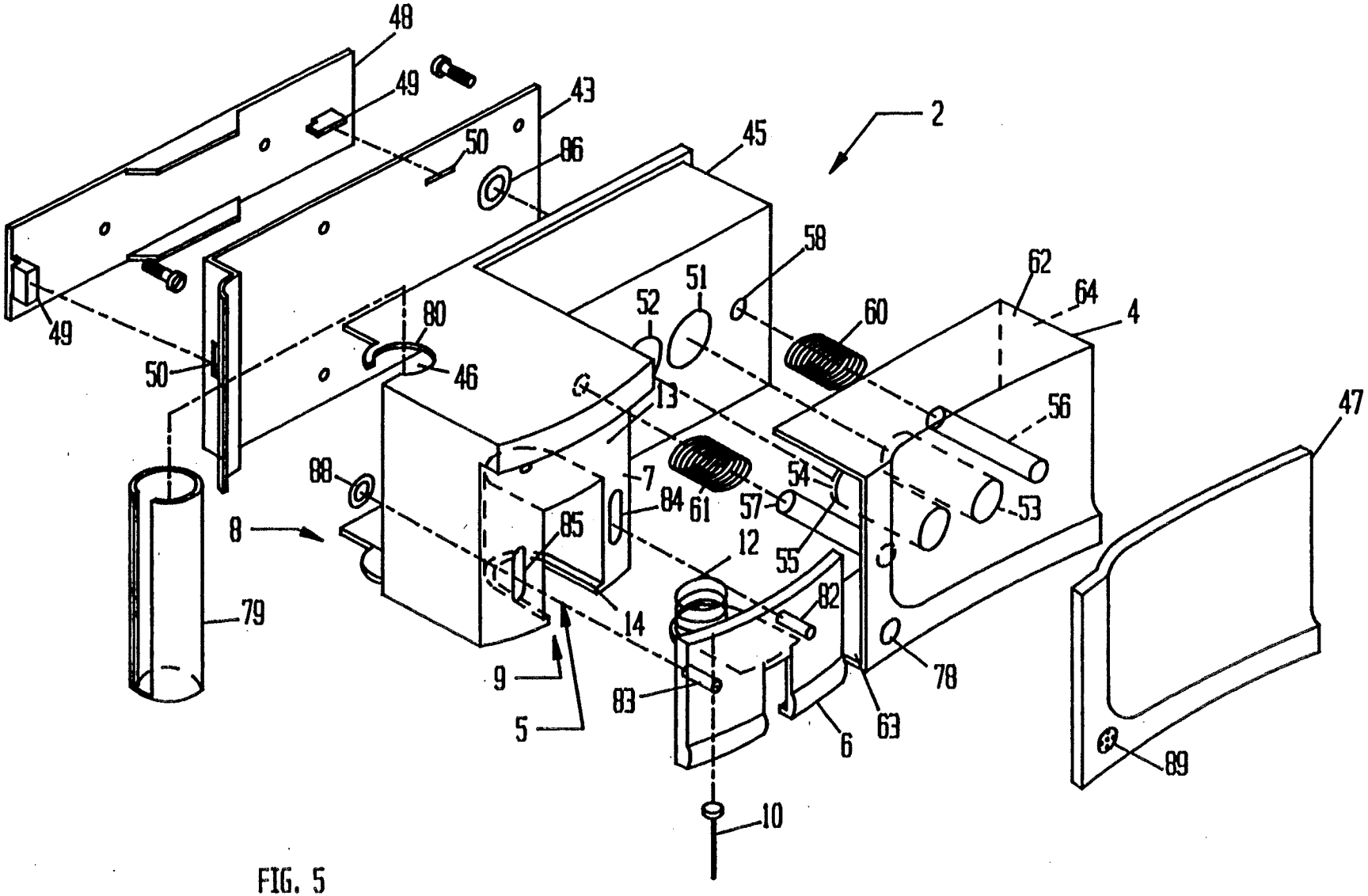
FIG. 5 is an exploded view of the pumping station assembly.
Figure 6:
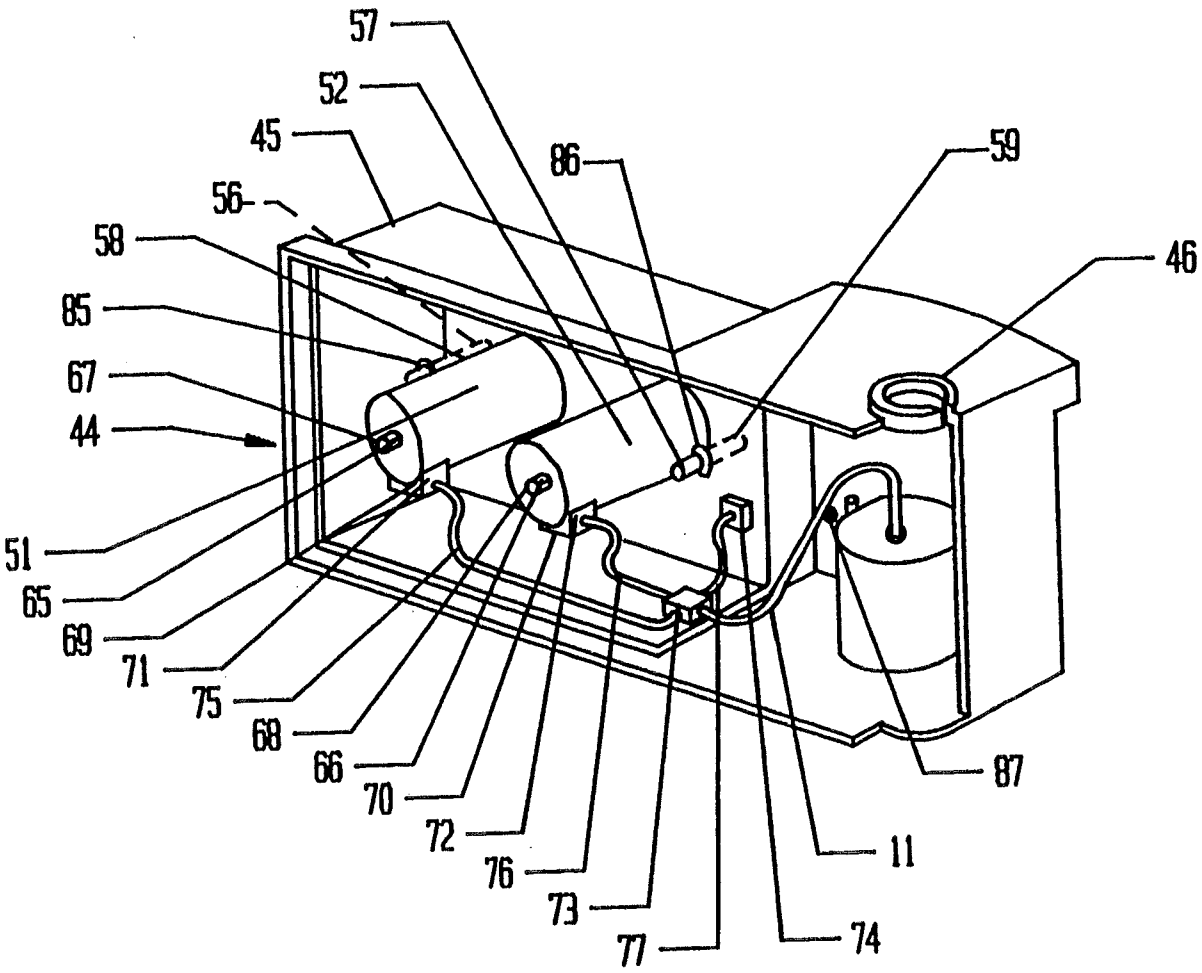
FIG. 6 is a back perspective view of the median portion of the pump station housing.

The major components of the pumping station 2 will now be disclosed with reference to FIGS. 5 and 6. The pumping station housing 2 comprises a back panel 43, a central body 44 defining the pump housing 45 and the filling station 9, the cap-holding station 46, the front panel 4 and its facia 47 and the filling station shield 6. A first type of mounting bracket 48 is designed to be secured to a wall and comprises a plurality of projections 49 which are designed to interface with corresponding notches 50 in the back panel, so that the pumping station 2 can be conveniently removed for cleaning or maintenance, then quickly re-installed against the wall. A second type of mounting bracket which is not illustrated, has a shelf projecting orthogonally from the upper edge of the bracket to provide convenient attachment to the undersurface of a kitchen cabinet or the like. The pump housing 45 defines a pair of cylindrical cavities 51 and 52 which are positioned and dimensioned to intimately engage a pair of corresponding pistons 53 and 54 projecting from the back of the front panel 4. O-rings 55 around each piston provide a tight, yet sliding movement of the pistons within the cylinders. The front panel is supported by two rods 56 and 57 mounted parallelly and astride the two pistons. The rods are slidingly engaged into corresponding guiding bores 58, 59 in the mid-section of the housing parallelly and astride to the cylinders. Coil-springs 60 and 61 concentrically engage on the rods 56 and 57 bias the front panel 4 away from the back panel 43. The frontal part of the pump housing section 45 is dimensioned to slidingly nest between the top projection 62, bottom projection 63, and lateral projection 64 extending orthogonally from the edges of the front panel 4, thus stabilizing the reciprocal movement of the front panel toward and away from the back panel 43 and median housing element 44 secured thereto. Each of the cylinders 53, 54 has an inlet 65, 66 fitted with a check valve 67, 68 which admits ambient air into the cylinder during the withdrawing movement of the front panel, and associated pistons, under the pressure of the springs 60 and 61. Each of the pistons is also equipped with an outlet 69, 70 fitted with a check valve 71,72 which allows expelling of the air from the cylinder when pressure is applied to the front panel against the coil spring 60 and 61. The check valve 71, 72 associated with the outlets are connected to a four-way fitting 73 and from there to the filling station 9 and to an audible pressure indicator 74 mounted on the front of the pump housing, by means of flexible conduits 75, 76, 77 and 11. The audible indicator 74 consists essentially of a safety valve preset to open at approximately 1.5 atmosphere (20 lbs. per square inch) followed by a whistle. The audible alarm is designed to signal the operator of the pumping station that sufficient pressure has been applied to the beverage container.

Figure 3:
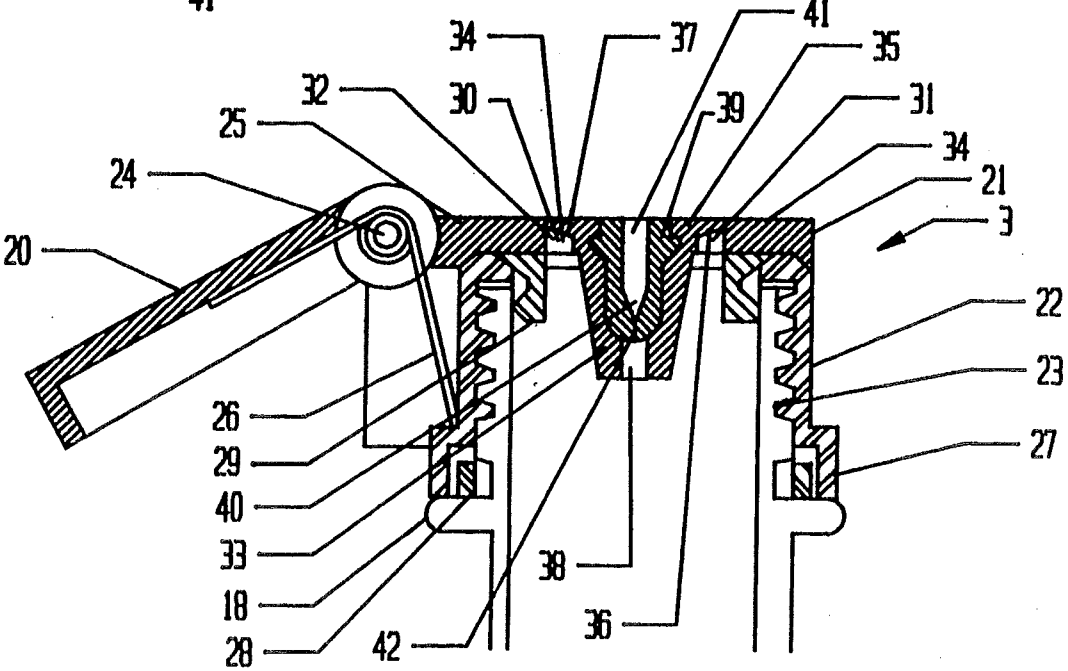
FIG. 3 is a cross-sectional view of a self-sealing cap.

The cap-holding station 46 consists essentially in a slotted sleeve 79 mounted in a circular notch 80 of the central body 44 and dimensioned to hold five or six self-sealing bottle caps of the type illustrated in FIGS. 1, 3 an 4. The levers 20 of each cap protruding through the slot 81 of the sleeve allows quick extraction of the caps and reinsertion into the sleeve 79.

The shield 6 and its associated shelf 10 supporting the cannula is slidingly guided and supported by two pins 82, 83 riding into corresponding slots 84, 85 in the front section of the filling stations 9. The front panel rods 56, 57 and the shield rods 82 and 83 are held in place by crimping washers 85, 86, 87 and 88. The front panel 4 and its facia 47 are appropriately drilled in front, 78, 89 of the audible indicator 74 for better sound transmission.

Figure 7:
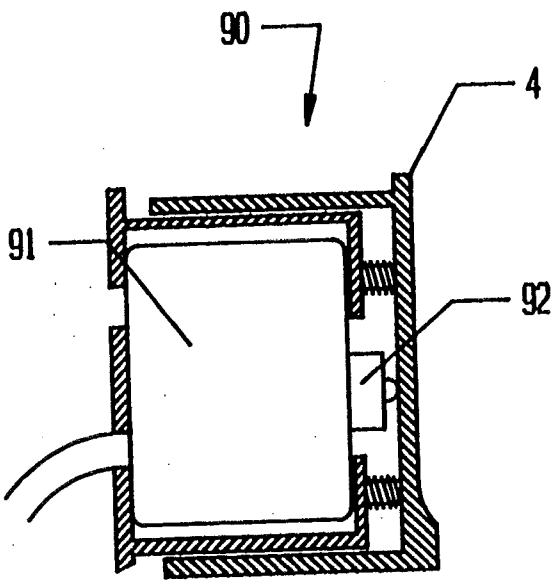
FIG. 7 is a partial view of the pump section of an alternate embodiment of the invention.

An alternate embodiment 90 of the pumping station illustrated in FIG. 7 uses an electrically driven air pump 91 in lieu of the piston and cylinder of the first embodiment to generate the pressurized air. The pump is activated by pushing the front panel 4 that is associated with the pump on/off switch 92.

While the preferred embodiments of the invention have been described, modifications can be made and other embodiments may be devised without departing from the spirit of the invention and the scope of the appended claims.

What is claimed is:

1. An apparatus for pressurizing a carbonated liquid container wherein said container includes a spout having a resealable pouring opening, said apparatus comprising:

a pumping station which comprises:

a housing having a back wall;

a movable front panel;

means associated with said housing for slidingly holding said front panel in a substantially vertical plane and frontal position in relation to said housing, and for allowing limited translating movement of said front panel toward and away from said back wall;

resilient means for biasing said panel away from said back wall;

a pump mounted between said back wall and said front panel and positioned to be operated by a translating movement of said front panel;

a cannula connected to said pump and projecting from a section of said housing;

means for resealing said pouring opening, said means for resealing having means for attaching said means for resealing to said spout and a resiliently self-sealing aperture shaped and dimensioned to be penetrated by said cannula;

wherein said means for resealing comprises:

a cap including a peripheral wall shaped and sized to intimately mate with said spout;

a top defining an upper surface and having said aperture;

a stopper inserted within said aperture, said stopper comprising a resilient body defining an upper section proximate said upper surface and a lower tip, and having a central channel tapering down from an intake hole in said upper section to a self-sealing pinhole through said lower tip;

said intake hole being sized to be penetrated by said cannula, whereby said pinhole is enlarged by forceful penetration of said cannula therethrough;

wherein said stopper further comprises:

a sleeve made of resilient material and having a central passage shaped and dimensioned to intimately hold said resilient body;

said sleeve including an outwardly projecting, flexible, peripheral flange proximate said upper surface;

said top defining a ledgered rim around said aperture, said rim comprising an upper circular area supporting said flange and having at least one notch exposing an under-section of said flange;

whereby excessive pressure within said container bearing against said exposed under-section can flex said under-section and provide a safety fluid escape.

2. The apparatus of claim 1, wherein a portion of said top is resiliently and partially separable from said peripheral wall to form a pouring orifice in said cap.

3. The apparatus of claim 2, wherein said portion of said top is hingedly attached to an upper section of said peripheral wall, and includes means for resiliently biasing said portion of said top toward a closed position, and a lever positioned to pivotally rotate said portion of said top about said upper section of said peripheral wall.

4. The apparatus of claim 2, wherein said peripheral wall includes a capping ledge around a lower edge of said peripheral wall opposite said top, said capping ledge projecting outwardly and downwardly to accommodate any section of a discarded sealing cap originally closing said spout remaining around said spout.

5. The apparatus of claim 1, wherein said housing comprises means for securing said pumping station to a stationary structure.

6. The apparatus of claim 1, which further comprises a safety valve connected to an outlet of said pump; and an audible alarm activated by said valve.

7. An apparatus for pressurizing a carbonated liquid container wherein said container includes a spout having a resealable pouring opening, said apparatus comprising:

a pumping station which comprises:

a housing having a back wall;

a movable front panel;

means associated with said housing for slidingly holding said front panel in a substantially vertical plane and frontal position in relation to said housing, and for allowing limited translating movement of said front panel toward and away from said back wall;

resilient means for biasing said panel away from said back wall;

a pump mounted between said back wall and said front panel and positioned to be operated by a translating movement of said front panel;

a cannula connected to said pump and projecting from a section of said housing;

means for resealing said pouring opening, said means for resealing having means for attaching said means for resealing to said spout and a resiliently self-sealing aperture shaped and dimensioned to be penetrated by said cannula; and wherein the housing of said pumping station comprises means for storing a plurality of said means for resealing.

8. The apparatus of claim 7, wherein said means for storing comprises said housing having a tubular cavity sized to hold said plurality of means for resealing;

said cavity having a longitudinal slot sized and positioned to engage levers of said plurality of means for resealing.

9. An apparatus for pressurizing a carbonated liquid container wherein said container includes a spout having a resealable pouring opening, said apparatus comprising:

a pumping station which comprises:

a housing having a back wall;

a movable front panel;

means associated with said housing for slidingly holding said front panel in a substantially vertical plane and frontal position in relation to said housing, and for allowing limited translating movement of said front panel toward and away from said back wall;

resilient means for biasing said panel away from said back wall;

a pump mounted between said back wall and said front panel and positioned to be operated by a translating movement of said front panel;

a cannula connected to said pump and projecting from a section of said housing;

means for resealing said pouring opening, said means for resealing having means for attaching said means for resealing to said spout and a resiliently self-sealing aperture shaped and dimensioned to be penetrated by said cannula wherein said cannula is positioned downwardly in a recess defined in a frontal and lower portion of said housing;

and wherein said housing further comprises a shield, and means for slidingly and vertically holding said shield across said recess in front of said cannula;

whereby said shield may be lowered to cover said means for resealing during operation of the apparatus.

10. The apparatus of claim 9, wherein said housing comprises means for securing said pumping station to a stationary structure.

11. The apparatus of claim 9, wherein said housing further comprises means for supporting the spout of said container in said recess while the self-sealing aperture of one of said means for resealing installed on said container is penetrated by said cannula.

12. The apparatus of claim 11 which further comprises a shelf extending orthogonally and inwardly from a back section of said shield and supporting said cannula; and a coil spring compressedly inserted between an upper surface of said shelf and an undersurface of a top section of said housing.

13. The apparatus of claim 9, wherein said apparatus further comprises:

a bracket;

means for securing said bracket to a wall; and means for releasably attaching said housing to said bracket.

14. An apparatus for pressurizing a carbonated liquid container wherein said container includes a spout having a resealable pouring opening, said apparatus comprising:

a pumping station which comprises:

a housing having a back wall;

a movable front panel;

means associated with said housing for slidingly holding said front panel in a substantially vertical plane and frontal position in relation to said housing, and for allowing limited translating movement of said front panel toward and away from said back wall;

resilient means for biasing said panel away from said back wall;

a pump mounted between said back wall and said front panel and positioned to be operated by a translating movement of said front panel;

means for conveying a fluid pressurized by said pump to a projection projecting from a section of said front panel;

means for resealing said pouring opening, said means for resealing having means for attaching said means for resealing to said spout and a resiliently self-sealing aperture shaped and dimensioned to be releasably connected to said projection;

wherein said housing comprises means for storing a plurality of said means for resealing.

15. An apparatus for pressurizing a carbonated liquid container wherein said container includes a spout having a resealable pouring opening, said apparatus comprising:

a pumping station which comprises:

a housing having a back wall;

a movable front panel;

means associated with said housing for slidingly holding said front panel in a substantially vertical plane and frontal position in relation to said housing, and for allowing limited translating movement of said front panel toward and away from said back wall;

resilient means for biasing said panel away from said back wall;

a pump mounted between said back wall and said front panel and positioned to be operated by a translating movement of said front panel;

means for conveying a fluid pressurized by said pump to a projection projecting from a section of said front panel;

means for resealing said pouring opening, said means for resealing having means for attaching said means for resealing to said spout and a resiliently self-sealing aperture shaped and dimensioned to be releasably connected to said projection;

wherein said projection is positioned downwardly in a recess defined in a frontal and lower portion of said housing;

and wherein said housing further comprises a shield, and means for slidingly and vertically holding said shield across said recess in front of said projection;

whereby said shield may be lowered to cover said means for resealing during operation of the apparatus.

16. The apparatus of claim 15, wherein said housing comprises means for securing said pumping station to a stationary structure.

17. The apparatus of claim 15, wherein said housing further comprises means for supporting the spout of said container in said recess while the self-sealing aperture of one of said means for resealing installed on said container is connected to said projection.

18. The apparatus of claim 17, which further comprises a shelf extending orthogonally and inwardly from a back section of said shield and supporting said projection; and a coil spring compressedly inserted between an upper surface of said shelf and an undersurface of a top section of said housing.

19. The apparatus of claim 15, which further comprises a safety valve connected to an outlet of said pump; and an audible alarm activated by said valve.

20. The apparatus of claim 15, wherein said apparatus further comprises:

a bracket;

means for securing said bracket to a wall; and means for releasably attaching said housing to said bracket.

* * * * *